US006991569B2

(12) United States Patent
Dobrounig

(10) Patent No.: US 6,991,569 B2
(45) Date of Patent: Jan. 31, 2006

(54) FOOTBALL

(75) Inventor: Otto Dobrounig, Saverne (FR)

(73) Assignee: adidas International Marketing B.V., Amsterdam (NL)

( * ) Notice: Subject to any disclaimer, the term of this patent is extended or adjusted under 35 U.S.C. 154(b) by 0 days.

(21) Appl. No.: 09/771,526

(22) Filed: Jan. 29, 2001

(65) Prior Publication Data

US 2001/0005702 A1 Jun. 28, 2001

Related U.S. Application Data

(63) Continuation of application No. 09/126,876, filed on Jul. 30, 1998, now Pat. No. 6,306,054.

(30) Foreign Application Priority Data

Jul. 30, 1997 (DE) ..... 197 32 824

(51) Int. Cl.
*A63B 41/08* (2006.01)

(52) U.S. Cl. ..... 473/599; 473/605

(58) Field of Classification Search ..... 473/569, 473/600, 601, 602, 603, 604, 605, 599, 593, 473/594, 595, 598

See application file for complete search history.

(56) References Cited

U.S. PATENT DOCUMENTS

| | | | | |
|---|---|---|---|---|
| 3,119,618 A | | 1/1964 | Molitor et al. | |
| 4,065,150 A | | 12/1977 | Van Auken | 280/610 |
| 4,154,789 A | | 5/1979 | Delacoste | 264/138 |
| 4,399,992 A | | 8/1983 | Molitor | 473/536 |
| 4,660,831 A | | 4/1987 | Kralik | 473/603 |
| 4,802,671 A | | 2/1989 | Gentiluomo | 473/126 |
| 5,040,795 A | | 8/1991 | Sonntag | |
| 5,091,265 A | | 2/1992 | Kennedy et al. | 473/601 |
| 5,104,126 A | | 4/1992 | Gentiluomo | 473/370 |
| 5,123,659 A | * | 6/1992 | Williams | 473/601 |
| 5,181,717 A | | 1/1993 | Donntag et al. | |
| 5,310,178 A | | 5/1994 | Walker et al. | 473/605 |
| 5,413,331 A | | 5/1995 | Stillinger | |
| 5,516,107 A | | 5/1996 | Okumoto et al. | 473/349 |
| 5,672,120 A | | 9/1997 | Ramirez et al. | 473/349 |
| 5,688,192 A | * | 11/1997 | Aoyama | 473/374 |
| 5,741,195 A | | 4/1998 | Sullivan et al. | 473/570 |
| 5,752,890 A | | 5/1998 | Shishido et al. | 473/599 |
| 5,759,123 A | | 6/1998 | Ou | 473/601 |
| 5,766,707 A | | 6/1998 | Obermaier | 428/35.7 |
| 5,772,545 A | | 6/1998 | Ou | 473/605 |
| 5,823,889 A | * | 10/1998 | Aoyama | 473/374 |
| 6,099,423 A | | 8/2000 | Ou | |
| 6,206,795 B1 | | 3/2001 | Ou | |
| 6,245,862 B1 | * | 6/2001 | Rajagopalan | 473/374 |

FOREIGN PATENT DOCUMENTS

DE 44 34 889 4/1995

(Continued)

OTHER PUBLICATIONS

European Search Report for DE application no. 98110837.6-2315 (Nov. 9, 1999).

*Primary Examiner*—Steven Wong
(74) *Attorney, Agent, or Firm*—Goodwin Procter LLP

(57) ABSTRACT

The present invention relates to a ball, in particular a football. The ball according to the invention has, in its outer skin, a syntactic material that consists of a matrix material into which essentially dimensionally stable, elastic blow-molded parts are mixed. Furthermore, a new method of producing a ball with a verre églomisé print is also disclosed.

15 Claims, 3 Drawing Sheets

FOREIGN PATENT DOCUMENTS

| | | |
|---|---|---|
| EP | 0 385 872 | 3/1990 |
| WO | 95/09034 | 4/1995 |
| WO | 96/40380 | 12/1996 |
| WO | 97/17109 | 5/1997 |

* cited by examiner

FOOTBALL

CROSS-REFERENCE TO RELATED APPLICATIONS

This application incorporates by reference, and claims priority to, and the benefit of, German patent application Ser. No. 19732824.5, which was filed on Jul. 30, 1997 and U.S. patent application Ser. No. 09/126,876, filed Jul. 30, 1998, now U.S. Pat. No. 6,306,054 of which this is a continuation.

BACKGROUND OF THE INVENTION

1. Technical Field

The present invention relates to a ball, and in particular a soccer ball, which comprises a top layer complex and middle and backing layer complexes. Furthermore, the present invention relates to a method of producing a top layer complex of a ball.

2. Prior Art

Various methods of producing balls are known from the prior art. In addition to the balls of a very simple construction (single-layer plastic balls), hand-sewn balls, in particular, are used in areas requiring high quality.

A known method of producing hand-sewn soccer balls, footballs, rugby balls, handballs, etc. is described, for example, in the document WO 95/09034. The construction of such a previously known ball and its production method are described below with reference to FIG. 5.

A ball 10 of the hand-sewn type is illustrated in FIG. 5. As can be seen from the figure, the ball 10 has an inflatable bladder core 9 that may consist, for example, of vulcanized latex. Located in the bladder core 9 is a valve (not illustrated) by means of which the ball can be inflated. Located on the bladder core 9 in the example illustrated are three layer complexes: a structure 12 which may consist, for example, of two or more (three in the example illustrated) fabric layers is used as backing layer complex (also known as backing complex). The different fabric layers are bonded to one another by means of suitable binding agents (usually dispersions in an aqueous solution). A layer of polyethylene foam (PE) is used as middle layer complex 13. Finally, in the example illustrated, the top layer complex 14 consists of a transparent film. In this previously known ball, the decorative markings 15 on the ball (decorations, references to the manufacturer and registered trade marks, etc.) are located between the transparent layer 14 and the layer of polyethylene foam 13.

A previously known ball 10 of this type is produced by having the decorative markings 15 applied to the inner side of a finished transparent outer layer 14. Subsequently, the middle layer complex 13 and the backing layer complex 12 are laminated onto the printed side of the transparent covering layer 14. Subsequently, the laminate (produced over a large area) is die cut in order to produce flat shapes (the usual triangles, pentagons, hexagons) which, when joined together, result in a hollow sphere. The ball elements are then sewn together by hand. The ball skin, produced in this way, is then placed on the inflatable core 11 (in the case of a laminated ball), or the inflatable core (11) is inserted into the ball skin before it is closed, as in the case of a hand-sewn ball.

In a ball of the non-hand-sewn type, an inflatable core is wrapped with a multidirectional filament structure that is stabilized and held together by means of vulcanizable bonding. The top layer complex 14 produced according to the above method can be bonded into correspondingly provided recesses in the filament structure with the aid of a nonwoven material (a felt or mat).

However, previously known balls of this type and the production methods described have the following disadvantages: on the one hand, the trajectory properties of balls of this type are not optimum owing to the structure of the outer skin. The same applies to the bounce properties and the impact characteristics of the ball. Furthermore, a disadvantage of the production method described above consists in the fact that, because the foam layer 13 is laminated onto the printed, prefabricated film 14, the bonding of these layers to one another is not optimum, which has an adverse effect on the abrasion resistance of the markings 15. Furthermore, although the PU films used for the transparent film are light stabilized, they are not lightfast. As a result, undesirable "yellowing" of the ball may occur as a result of the adhesive bonding. Finally, the transparent PU films have the disadvantage that they are slippery in wet conditions, and make the ball difficult to control.

One object of the present invention is therefore to provide a high quality ball and a reliable method of producing it. A ball according to the invention has optimum bounce and trajectory properties, feels "soft" on the foot, is fast in flight, permits optimum handling and optimum ball control, and meets or exceeds the specifications required by FIFA. Furthermore, a ball according to the invention embodies a high degree of roundness and dimensional stability, a high degree of abrasion resistance, and a low degree of water absorption.

SUMMARY OF THE INVENTION

The above mentioned problems are addressed by a ball and according to the invention, by the claimed methods of producing a top layer complex of a ball.

Specifically, the problems underlying the invention are solved by a ball, in particular by a soccer ball, whose outer skin includes a syntactic material. Syntactic materials are mixtures that consist of a matrix material into which essentially dimensionally stable, resilient bodies are dispersed.

A category of syntactic materials which are particularly preferred according to the present invention are syntactic foams which, in contrast to conventional foams, are not expanded by means of a chemical propellant or water, but by mixing in elastic, preferably spherical hollow spheres.

The microspheres that are particularly preferred according to the present invention can be procured commercially, for example under the trade name "DUALITE". DUALITE hollow spheres are spheres that are closed in the manner of a balloon and can be filled either with airor with another suitable gas, as a result of which, on the one hand, they are compressible and, on the other hand, assume their original shape again as soon as the pressure acting upon them diminishes. Soft microspheres of this type are extremely pressure-resistant and burst only under very high pressures.

The properties of the preferred hollow microspheres syntactic foams having excellent result in elasticity, which results in excellent bounce characteristics when they are used in balls and, in particular, in soccer balls.

Syntactic foams are known. They are used, for example, in aerospace technology, where there is a high requirement for epoxy resin or similar engineering resins as construction material. However, a disadvantage of pure epoxy resin is that it has a considerable density and thus a considerable weight. Epoxy resin cannot be foamed to reduce its weight. For this reason, consideration was given to embedding hollow glass spheres in epoxy resin in order to reduce its weight and increase its stability. Up to now, however, syntactic foams have only been used to increase the stability of the matrix material and to reduce its weight at the same time.

Up to now, no consideration has been given to using syntactic foams in outer skins of balls.

The present invention is also embodied in a method of producing a top layer complex of a ball, in particular a soccer ball, which comprises the following steps:

a) spreading a transparent liquid polymer over a backing film and subsequently solidifying the liquid polymer in order to produce a transparent layer of plastic;

b) printing a desired pattern or symbol on the solidified transparent layer of plastic;

c) spreading a second liquid polymer over the solidified, transparent and now imprinted layer of plastic and subsequently solidifying the second liquid polymer in order to produce a layer combination;

d) cutting the layer combination in order to produce ball elements; and e) subsequently joining the ball elements together, possibly with further ball layer complexes and an inflatable bladder in order to produce the ball.

The inventive method of producing a top layer complex differs from the previously known production method in that no prefabricated transparent plastic film is used, but firstly only a high-gloss release paper over which a transparent liquid polymer is spread using a spreading knife. The liquid polymer on is subsequently heat-cured in an oven and is then printed. In a second production operation, a liquid polymer is again spread over the cured transparent, printed layer and, like the first layer of plastic, is heat-cured by means of an oven.

The "layered" plastic skin produced in this manner is distinguished by the fact that as a result of the particularly intimate bonding of the two layers the plastic skin behaves in such a way, with regard to its elastic properties, as if it were made of only one layer. The markings printed on the back of the first solidified layer of plastic are, so to speak, cast in by having the second liquid polymer layer spread over them and are thus sealed so that the markings are extremely resistant to abrasion against friction forces occurring within the outer skin.

BRIEF DESCRIPTION OF THE DRAWINGS

The currently preferred embodiments of the present invention are described below with reference to the drawing, in which.

DESCRIPTION OF THE PREFERRED EMBODIMENTS

The currently preferred embodiments of the present invention are described below with reference to the drawings. However, it is expressly pointed out that the present invention is not limited to these embodiments, but also includes others. In particular, the present invention should not be restricted to soccer balls, but could be applied to other types of balls as well.

Figure 1:
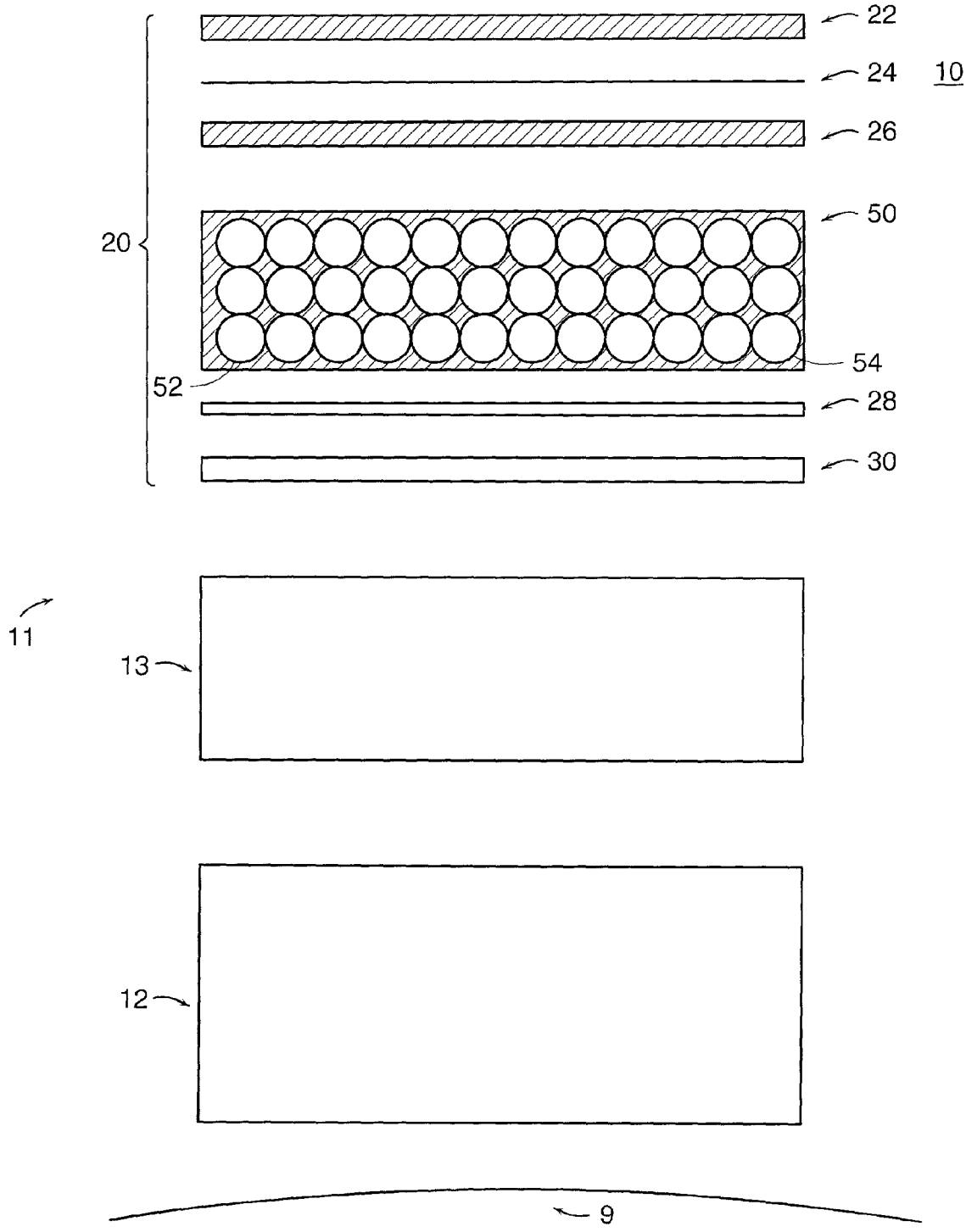
FIG. 1 shows a cross-section through the inventive layered structure of the outer skin of a ball.

The first preferred embodiment of the present invention is illustrated in FIG. 1. A cross-section through the outer skin 11 of a ball 10 according to the invention can be seen. In the embodiment illustrated, the outer skin 11 consists of a top layer complex 20, a middle layer complex 13, and a backing layer complex 12, which enclose on an inflatable bladder core 9. The middle layer complex 13 and the backing layer complex 12 are illustrated only schematically. The inflatable bladder core 9 has an inlet (not illustrated) which is provided with a valve and by means of which the ball can be inflated. The backing layer complex 12 preferably comprises two to four (three in the example shown) separate fabric layers which may consist of polyester fabrics in a basket weave or similar type of weaving, or knitted fabrics. The middle layer complex 13 preferably consists of polyethylene foam.

It is pointed out that the construction consisting of the inflatable bladder core 9, the backing layer complex 12 and the middle layer complex 13 is known in the prior art hand-sewn balls.

According to the first preferred embodiment of the present invention according to FIG. 1, the syntactic material according to the invention is used in the top layer complex 20 which, in the embodiment illustrated, consists of six individual layers.

The outer layer 22 involves an aliphatic transparent layer which has extremely high strength and abrasion resistance, and which is resistant to undesirable yellowing when it ages. The next layer 24 involves the markings that determine the ball's exterior decorative appearance. Since the outer layer 22 is transparent, the markings (usually decorations, trademarks or other inscriptions) are visible through the transparent layer 22. As will be explained in greater detail later, this layer is printed on the inner side of the aliphatic outer layer 22 using a screen printing or transfer printing method.

The next layer 26 in the sequence of layers involves an aliphatic middle layer that is preferably white, but can also be of a different color such as fluorescent green or fluorescent red. Fluorescent green or fluorescent red balls are popular, in particular, in games that take place at dusk. The layer 26 gives the finished ball its familiar white (or colored) appearance.

The next layer 50 in the sequence of layers involves the syntactic foam layer according to the invention. According to the preferred embodiment, polyurethane is used as matrix material 52 into which hollow spheres 54 are mixed. Polyurethane foams or PVC can also be used. The hollow spheres 54 can be obtained commercially, for example under the name "DUALITE" from the company_LW AG (Traiskirchen, Austria). This material consists of expanded acrylonitrile copolymer. DUALITE has the appearance of a white powder whose specific density is 0.13 g/cm$^3$, the diameter of the individual microspheres being about 70 $\mu$m. The DUALITE microspheres have a high compression stability; they can be loaded with a pressure of up to 140 kg/cm$^2$ without breaking. DUALITE is available from different manufacturers under different trade names, and in different densities and sizes.

According to the invention, different mixing ratios of the matrix material 52 and the micro-spheres 54 were examined to evaluate their suitability for use in balls. It was found that the proportion of microspheres 54 in relation to polyurethane 52 is preferably between 1% and to 20% by weight, a more preferably between 2% by weight and 5% by weight, and most preferably about 4% by weight.

The next layer 28 in the sequence of layers is an adhesive layer (a polyurethane adhesive) which serves to bond a backing layer 30 to the sequence of layers 22, 24, 26 and 50. The backing layer 30 preferably consists of a fabric of mixed polyester and cotton.

Figure 5:
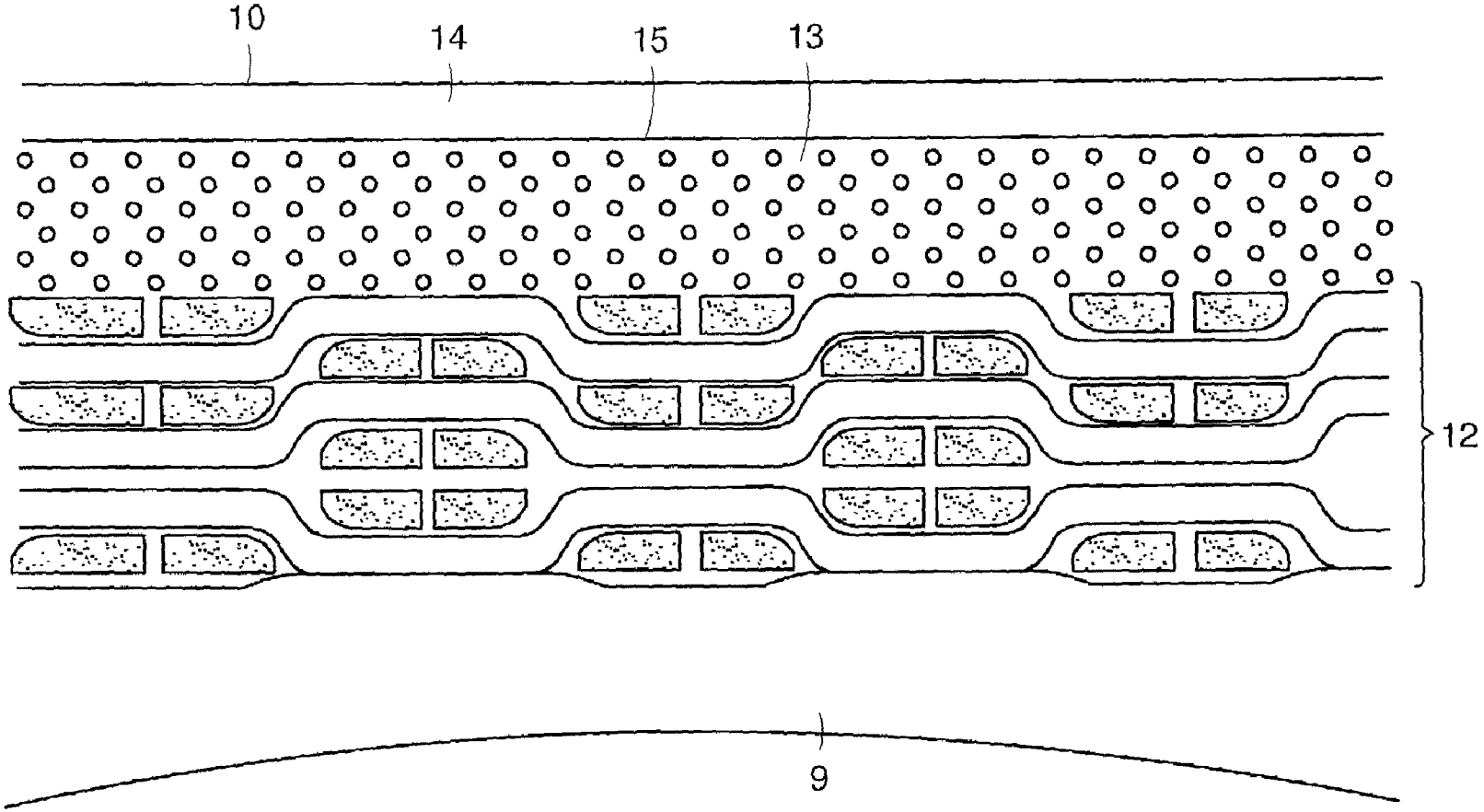
FIG. 5 PRIOR ART
FIG. 5 shows a cross-section through the skin of a prior art ball.

The excellent properties of a ball with the above construction can be attributed to the use of the syntactic foam according to the invention. The foam layer 13 conventionally used in the prior art (see FIG. 5) has a nonuniform bubble structure inside it, since it has been expanded in a conventional manner (either chemically or using water). The bubbles produced in this way only have a spherical shape in exceptional cases. The air entrapments in such foams are usually kidney-shaped or randomly shaped. This results in the uneven and therefore undesirable elasticity properties of the ball.

In contrast, in the present invention, all the hollow spheres used are largely identical. They have precisely defined elasticity and temperature characteristics. Both the elasticity characteristics and the temperature characteristics of the ball can be adjusted according to the invention in that the microspheres, instead of being filled with air, are filled with a specific gas at a specific pressure.

The inventive method of producing the top layer complex 20 according to the invention is described below with reference to FIG. 1.

According to the invention, a high-gloss release paper, which is commercially available as piece goods, is mounted on a rotatable roll. The end of the high-gloss release paper is attached to a take-up roll that is driven by means of an electric motor. The high-gloss release paper is then wrapped around the take-up roll. Located between the rotatable roll and the take-up roll are a workbench and an oven. The high-gloss release paper is slowly drawn over the bench and then through the oven by the take-up roll.

Located in front of the oven is a dispensing machine with a spreading knife which applies a uniform layer of a liquid aliphatic material (transparent outer layer 22) to the slowly moving high-gloss release paper. After the liquid aliphatic material has been applied, the release paper passes through the oven, where the liquid aliphatic material cures and crosslinks, and onto the take-up roll. The release paper is then rolled onto the empty roll as a result of the rotation of the latter until a roll is thus produced, consisting of the high gloss release paper and the transparent outer layer 22.

The desired markings, decorations or the like are then subsequently printed onto layer 22 by screen printing or transfer printing methods which are known in the art. The roll obtained in this manner, now consisting of the high-gloss release paper, the cuter layer 22 and the verre églomisé print 24 is again introduced into the bench-dispensing machine-oven device described above to apply the middle layer 26. Accordingly, the dispensing machine contains the liquid aliphatic material that is applied to form white middle layer 26. The spreading doctor knife can be adjusted in a suitable manner in order to set the required thickness of the aliphatic middle layer 26.

The roll thus obtained (now consisting of the high gloss release paper, the outer layer 22, the verre églomisé print 24 and the middle layer 26) is again introduced into the bench-dispensing machine-oven described above to apply the syntactic foam 50. According to the invention, the syntactic foam is applied in the required thickness and is dried by means of the oven.

Finally, the layer combination thus produced (now consisting of the high-gloss release paper, the outer layer 22, the verre églomisé print 24, the middle layer 26, the layer of syntactic foam 50) is coated with a liquid adhesive layer 28. A backing layer 30 is placed and roll pressed onto the liquid adhesive layer 28. The now complete layer combination then passes through the oven to cure the adhesive. The high-gloss release paper is pulled off as a last step of the method, producing the complete top layer complex.

Alternatively, the above production operation can also be completed in a single production line, in which the individual layers are applied at sequential dispensing machine-oven stations.

The top layer complex 20 thus obtained is then bonded to the middle layer complex 13 and the backing layer complex 12. This is done, for example, using natural latex. Additionally, this now complete surface complex provided with the verre églomisé print can be printed with other motifs in a conventional manner.

Finally, the ball skin 10 thus obtained is cut in order to produce the individual ball elements (usually pentagonal or hexagonal) which are then sewn together to produce the finished ball 10.

In the first embodiment described above, the syntactic material according to the invention is used as a foam layer 50 in the top layer complex 20 of the ball skin 11. In another preferred embodiment of the invention the microspheres 54 are mixed with the latex material, by means of which the top layer complex 20, the middle layer complex 13 and the backing layer complex 12 are bonded together. This has the advantage that, on the one hand, the elastic properties of the ball are further improved, and the weight of the ball is reduced since natural latex actually has a considerable weight.

As has been described in detail above, the ball according to the invention has improved properties in comparison with previously known balls as best explained by reference to FIGS. 2–4.

Figure 2:
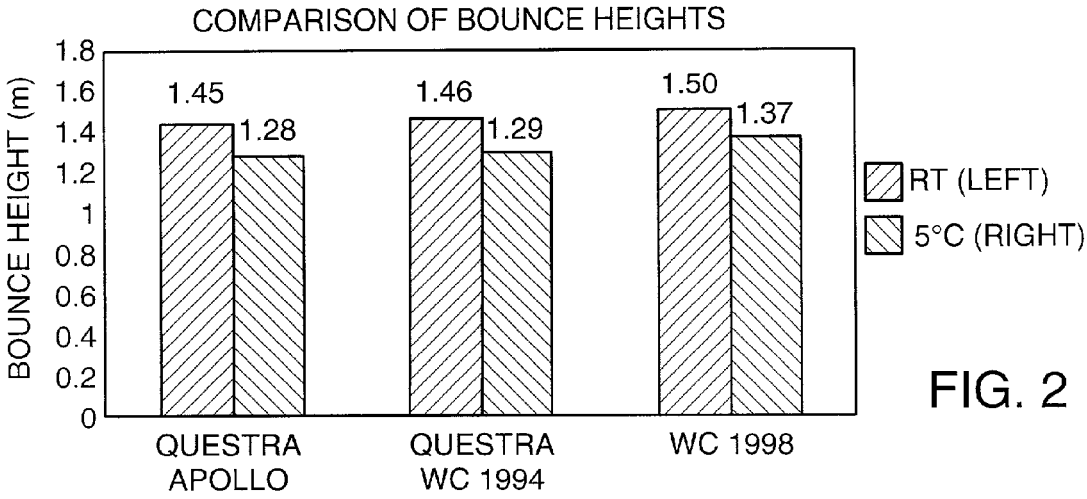
FIG. 2 shows a comparison of the bounce heights of a ball produced according to the present invention with prior art balls as a function of temperature.

In FIG. 2, the bounce height of the ball according to the invention was compared with the bounce heights of previously known balls at different temperatures. The balls were dropped from a height of 2 meters, and the bounce height (=rebound height) was measured. The ball made according to the invention (Wc 1998) was compared with the previously known balls Questra Apollo and Questra Wc 1994 at room temperature (RT) and at 5° C. As can be seen from the diagram, the bounce height of the ball according to the invention was 1.50 m at room temperature, whereas it was only 1.45 m and 1.46 m respectively for the previously known balls. At 5° C., the difference turned out to be even greater. The bounce height of the ball according to the invention was 1.37 m, the previously known balls bounced only to a height of 1.29 m and 1.28 m respectively. The comparison thus shows that the ball according to the invention has improved bounce properties, and its bounce properties are less affected by temperature.

Figure 3:
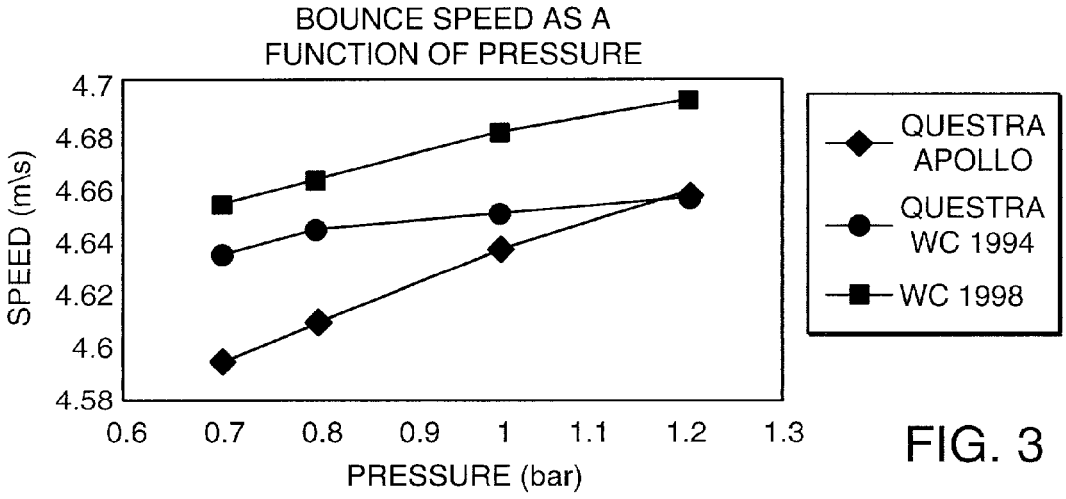
FIG. 3 shows a diagram in which the bounce speed as a function of the pressure of a ball according to the present invention is compared with prior art balls.

FIG. 3 illustrates the bounce speed as a function of the ball pressure. As can be seen from the diagram, the ball according to the invention shows higher bounce speeds than the previously known balls over the entire ball pressure range illustrated.

Figure 4:
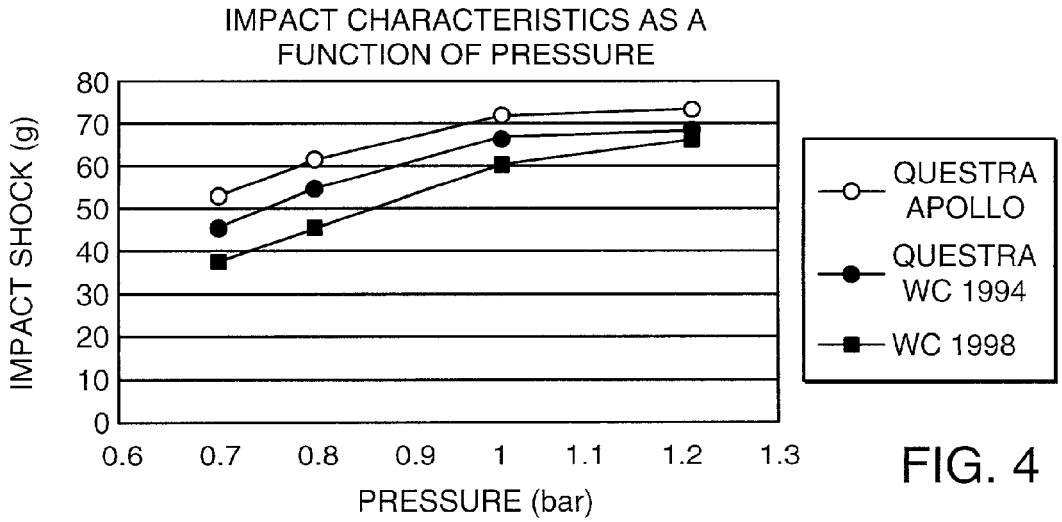
FIG. 4 shows a diagram in which the impact characteristics of a ball according to the invention as a function of the ball pressure is compared with prior art balls.

Finally, FIG. 4 shows the response characteristics of the ball with regard to impacts (shock characteristics) as a function of the ball pressure. As can be seen, from the ball according to the invention generates less impact shock than the previously known balls, in particular at low ball pressures. This demonstrates the improved elasticity characteristics of the ball according to the invention.

Finally, the inventive concept of using a synthetic material is not limited to hand-sewn balls, but can also be used for laminated balls. In this case, the backing layer complex is replaced by the carcass. The same applies to the claimed method of producing an outer covering for a ball.

Those skilled in the art will recognize that the foregoing embodiments can be varied without departing from the scope of the invention.

What is claimed is:

1. A finished ball comprising an outer skin having a plurality of layer complexes, including at least one inner layer complex and an outermost layer complex forming a top layer complex of the finished ball, wherein the top layer complex comprises a plurality of pre-bonded layers forming an inseparable layer that includes a syntactic material that comprises a plurality of resilient spherical bodies dispersed in a matrix material.

2. A ball according to claim 1 wherein the spherical bodies comprise microspheres.

3. A ball according to claim 1 wherein the spherical bodies comprise polymeric hollow microspheres.

4. A ball according to claim 1 wherein the spherical bodies comprise acrylonitrile copolymer microspheres.

5. A ball according to claim 1 wherein the matrix material is selected from the group consisting of polyurethane, polyurethane foam, polyvinyl chloride, and latex.

6. A ball according to claim 1 wherein the top layer complex comprises a first layer and a second layer adjacent the first layer.

7. A ball according to claim 6 wherein the second layer comprises an aliphatic material.

8. A ball according to claim 6 wherein the top layer complex further comprises a third layer adjacent the first layer.

9. A ball according to claim 8 wherein the third layer comprises at least one fabric backing material.

10. A ball according to claim 1 wherein the matrix material is an adhesive.

11. A ball according to claim 1 further comprising a middle skin adjacent to the outer skin, a backing layer adjacent to the middle skin, and an inflatable bladder adjacent to the backing layer.

12. A ball according to claim 1, wherein the outer skin is formed from a plurality of cut pieces and the plurality of cut pieces are joined together.

13. A ball according to claim 12 wherein the plurality of cut pieces are sewn together.

14. A ball according to claim 1, wherein the spherical bodies are not more than 20% by weight of the matrix material.

15. A ball according to claim 1, wherein the spherical bodies are not less than 1% by weight of the matrix material.

* * * * *